US009926932B2

(12) United States Patent
Perevozchikov et al.

(10) Patent No.: US 9,926,932 B2
(45) Date of Patent: Mar. 27, 2018

(54) DISCHARGE VALVE AND COMPRESSOR COMPRISING SAME

(71) Applicant: EMERSON CLIMATE TECHNOLOGIES (SUZHOU) CO., LTD., Jiangsu (CN)

(72) Inventors: Michael M. Perevozchikov, Jiansu (CN); Thomas R. Hodapp, Jiangsu (CN); Zhigang Fang, Jiangsu (CN); Qiang Liu, Jiangsu (CN); Hongshan Li, Jiangsu (CN)

(73) Assignee: Emerson Climate Technologies (Suzhou) Co., Ltd., Jiangsu (CN)

( * ) Notice: Subject to any disclaimer, the term of this patent is extended or adjusted under 35 U.S.C. 154(b) by 357 days.

(21) Appl. No.: 14/427,128

(22) PCT Filed: Jul. 5, 2013

(86) PCT No.: PCT/CN2013/078898
§ 371 (c)(1),
(2) Date: Mar. 10, 2015

(87) PCT Pub. No.: WO2014/040449
PCT Pub. Date: Mar. 20, 2014

(65) Prior Publication Data

US 2016/0201673 A1 Jul. 14, 2016

(30) Foreign Application Priority Data

Sep. 14, 2012 (CN) ..... 2012 1 0341677
Sep. 14, 2012 (CN) ..... 2012 2 0470547 U

(51) Int. Cl.
*F04C 28/24* (2006.01)
*F04C 18/02* (2006.01)
(Continued)

(52) U.S. Cl.
CPC ..... *F04C 28/24* (2013.01); *F04C 18/0215* (2013.01); *F04C 29/128* (2013.01); *F04C 23/008* (2013.01)

(58) Field of Classification Search
CPC ..... F04C 28/24; F04C 29/128; F16K 15/035; F16K 15/144
See application file for complete search history.

(56) References Cited

U.S. PATENT DOCUMENTS 5,346,375 A * 9/1994 Akiyama ..... F04C 29/128 137/512
6,213,731 B1 4/2001 Doepker et al.
(Continued)

FOREIGN PATENT DOCUMENTS

CN 1854525 A 1/2006
CN 1896519 A 1/2007
(Continued)

OTHER PUBLICATIONS

International Search Report and Written Opinion of the ISA for PCT/CN2013/078898, ISA/CN, dated Oct. 10, 2013.
(Continued)

*Primary Examiner* — Mary A Davis
(74) *Attorney, Agent, or Firm* — Harness, Dickey & Pierce, P.L.C.

(57) ABSTRACT

Disclosed is an exhaust valve (10A, 10B, 10C, 10D, 10E), comprising a valve body (12), wherein the first end of the valve body is provided with a fluid inlet (15); the sidewall of the valve body is provided with at least one fluid outlet (17) in fluid communication with the fluid inlet (15) and a valve flap (20) for opening or closing the fluid outlet; and the axis direction of the fluid outlet (17) is inclined relative to that of the fluid inlet (15). Further disclosed is a compressor comprising the above-mentioned exhaust valve. The exhaust valve has a relatively low fluid resistance, and is able to
(Continued)

significantly reduce the pressure drop in the compressor due to the exhaust valve, so that the operating efficiency of the compressor is increased.

25 Claims, 9 Drawing Sheets

(51) Int. Cl.
*F04C 29/12* (2006.01)
*F04C 23/00* (2006.01)

(56) References Cited

U.S. PATENT DOCUMENTS

| | | | |
|---|---|---|---|
| 6,672,846 | B2 | 1/2004 | Rajendran et al. |
| RE40,257 | E | 4/2008 | Doepker et al. |
| 7,429,167 | B2 | 9/2008 | Bonear et al. |
| 2002/0159898 | A1 | 10/2002 | Rajendran et al. |
| 2006/0233657 | A1 | 10/2006 | Bonear et al. |

FOREIGN PATENT DOCUMENTS

| | | | | | |
|---|---|---|---|---|---|
| CN | 1995756 | A | | 7/2007 | |
| CN | 202117891 | U | | 1/2012 | |
| CN | 202789552 | U | | 3/2013 | |
| DE | 4118934 | A1 | * | 12/1992 | ..... F04C 29/128 |
| JP | H07-97992 | A | | 4/1995 | |
| JP | H07-130169 | A | | 4/1995 | |
| JP | H08261186 | A | | 10/1996 | |
| JP | 2002371965 | A | * | 12/2002 | ..... F04C 29/128 |
| JP | 2004324485 | A | | 11/2004 | |
| JP | 2009-162077 | A | | 7/2009 | |
| JP | 2012117392 | A | | 6/2012 | |
| WO | WO-03040563 | A1 | | 5/2003 | |

OTHER PUBLICATIONS

First Chinese Office Action regarding Application No. 201210341677.2 dated Jul. 14, 2015. English translation provided by Unitalen Attorneys at Law.

* cited by examiner

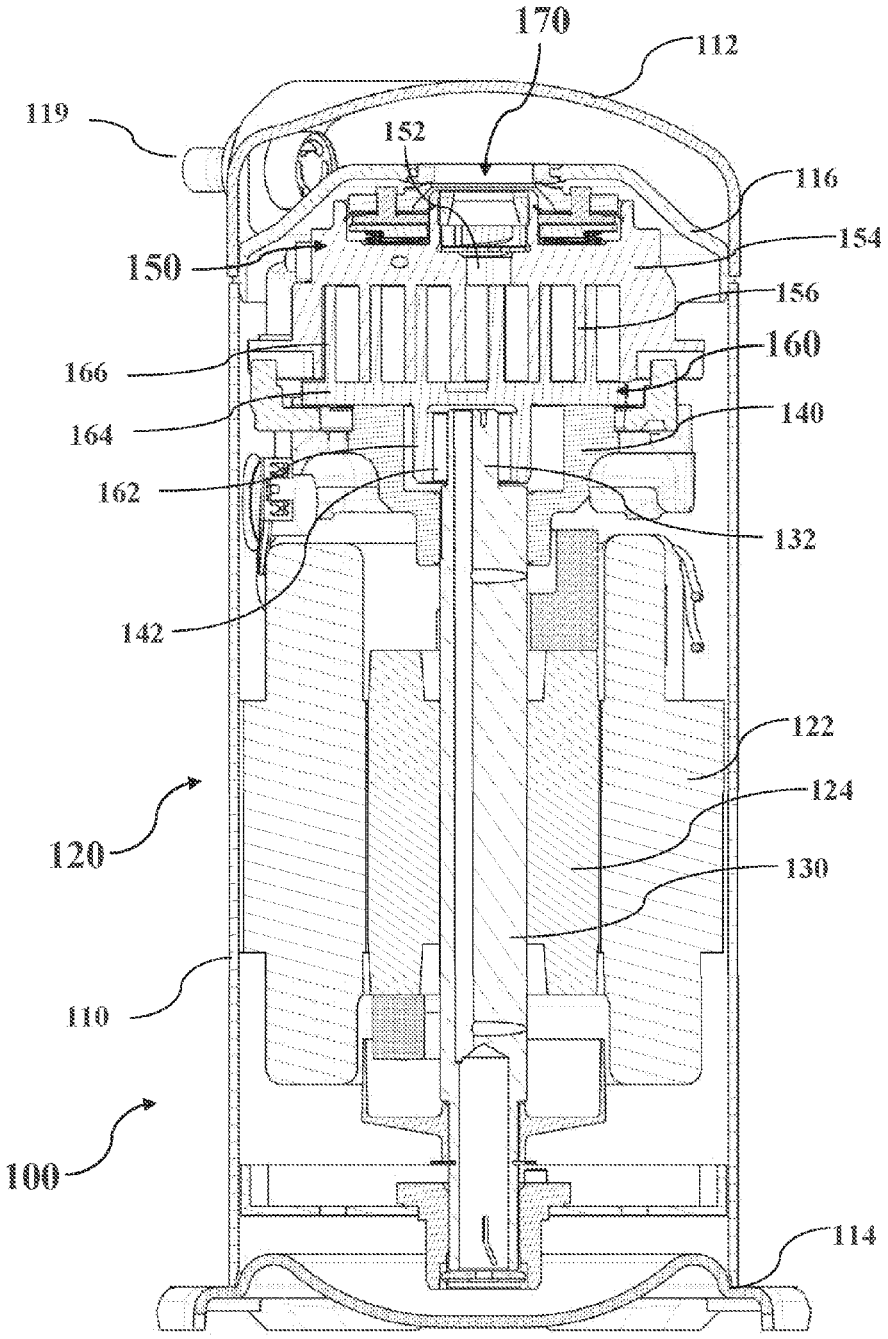
Fig. 1 - PRIOR ART -

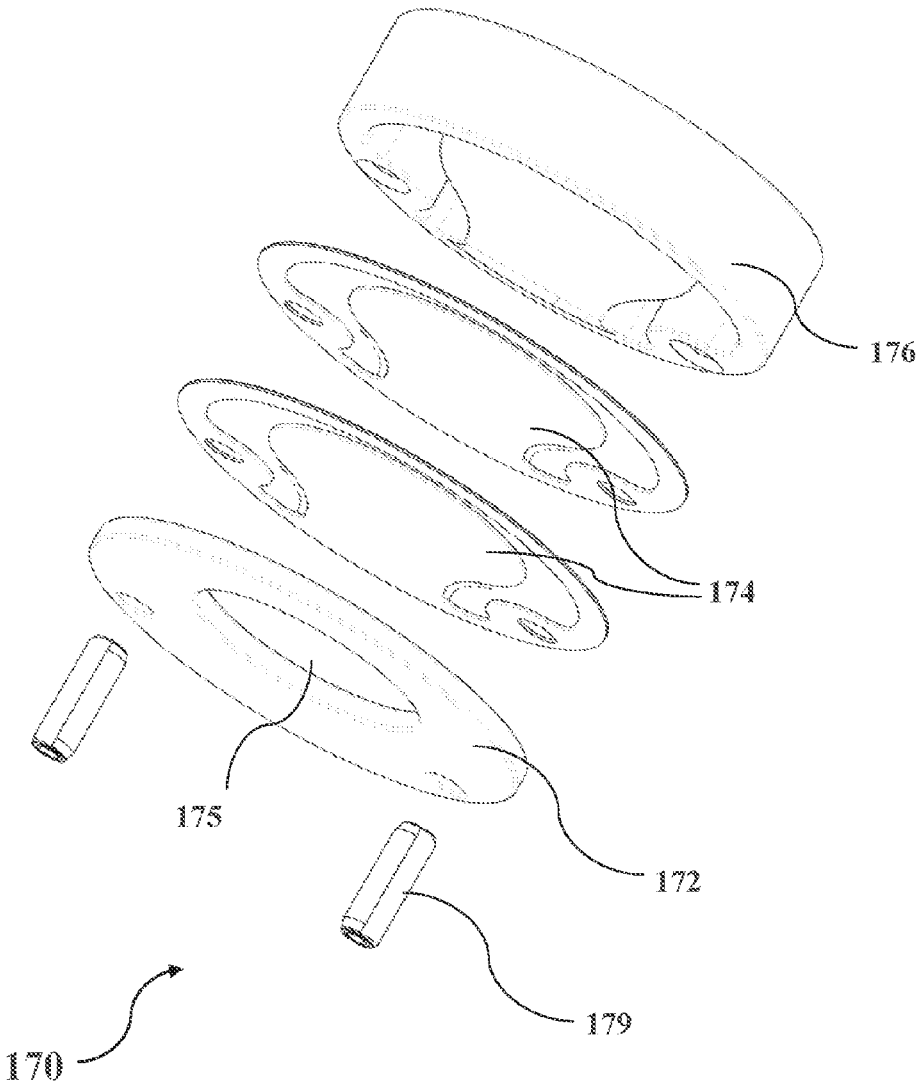
Fig. 2 - PRIOR ART -

- PRIOR ART -

- PRIOR ART -

- PRIOR ART -

DISCHARGE VALVE AND COMPRESSOR COMPRISING SAME

CROSS-REFERENCE TO RELATED APPLICATIONS

This application is the national phase of International Application No. PCT/CN2013/078898, titled "EXHAUST VALVE AND COMPRESSOR COMPRISING SAME", filed on Jul. 5, 2013, which claims the priorities to Chinese Patent Application No. 201210341677.2 titled "DISCHARGE VALVE AND COMPRESSOR INCLUDING THE SAME", filed with the Chinese State Intellectual Property Office on Sep. 14, 2012, and Chinese Patent Application No. 201220470547.4 titled "DISCHARGE VALVE AND COMPRESSOR INCLUDING THE SAME", filed with the Chinese State Intellectual Property Office on Sep. 14, 2012, the entire disclosures of which are incorporated herein by reference.

TECHNICAL FIELD

The application relates to a discharge valve and a compressor including the discharge valve.

BACKGROUND

As shown in FIG. 1, a conventional scroll compressor 100 generally includes a housing 110, a top cover 112 arranged at one end of the housing 110, a bottom cover 114 arranged at the other end of the housing 110, and a partition plate 116 arranged between the top cover 112 and the housing 110 for separating an inner space of the compressor into a high pressure side and a low pressure side. The high pressure side is formed between the partition plate 116 and the top cover 112, and the low pressure side is formed among the partition plate 116, the housing 110 and the bottom cover 114. An inlet connector (not shown) is arranged at the low pressure side for suctioning fluid, and an outlet connector 119 is arranged at the high pressure side for discharging the compressed fluid. A motor 120 including a stator 122 and a rotor 124 is arranged in the housing 110. A driving shaft 130 is provided in the rotor 124 to drive a compressing mechanism including a non-orbiting scroll 150 and an orbiting scroll 160. The orbiting scroll 160 includes an end plate 164, a hub 162 formed at one side of the end plate, and a spiral blade 166 formed at the other side of the end plate. The non-orbiting scroll 150 includes an end plate 154, a spiral blade 156 formed at one side of the end plate, and a discharge port 152 formed at a substantially central position of the end plate. The orbiting scroll 160 is supported at one side by a main bearing housing 140, and the driving shaft 130 is also supported at one end by the main bearing housing 140. An eccentric crankpin 132 is provided at one end of the driving shaft 130, and an unloading liner 142 is provided between the eccentric crankpin 132 and the hub 162 of the orbiting scroll 160. Being driven by the motor 140, the orbiting scroll 160 orbits relative to the non-orbiting scroll 150 (i.e., the central axis of the orbiting scroll 160 rotates about the central axis of the non-orbiting scroll 150, however, the orbiting scroll 160 itself cannot rotate about its central axis) to compress the fluid. The fluid compressed by the non-orbiting scroll 150 and the orbiting scroll 160 is discharged to the high pressure side via the discharge port 152. A one-way valve or a discharge valve 170 is provided at the discharge port 152 in order to prevent the fluid at the high pressure side from flowing back to the low pressure side via the discharge port 152 under certain circumstances.

FIG. 2 shows an exploded perspective view of a conventional discharge valve 170. As shown in FIG. 2, the discharge valve 170 includes a substantially annular valve seat 172 (a valve port 175 is provided in the valve seat 172), at least one valve flap 174 arranged at the valve seat 172 for opening or closing the valve port, a valve stop 176 for preventing the valve flap from being excessively deformed, and a pin 179 for fixing the above components together. The discharge valve 170 with the above construction is fixed in the hub 153 in the vicinity of the discharge port 152 of the non-orbiting scroll 150 (shown in FIG. 4) via a holder 178 (see FIG. 4). FIG. 3A shows the discharge valve 170 in a closed state, and FIG. 3B shows the discharge valve 170 in an opened state.

In the conventional discharge valve 170 shown in FIGS. 2 to 4, due to the specific position relationship of the valve seat 172, the valve stop 176 and the holder 178 relative to the discharge port 152 of the non-orbiting scroll 150, when the compressed fluid is discharged from the discharge port 152 to the high pressure side, the flowing direction of the fluid is turned by substantially 90 degrees each time at portions A, B, C and D shown in FIG. 4. An upper surface of the valve seat 172 is perpendicular to an axis direction of the discharge port 152 (or the valve port 175 in the valve seat 172). Thus, when the valve flap 174 opens, the fluid has to be turned by substantially 90 degrees (at position A). Next, since an axis direction of a flowing passage in the valve stop 176 is substantially parallel to the axis direction of the discharge port 152, the fluid flowing out of the valve flap 174 along substantially a horizontal direction has to be turned again by substantially 90 degrees (at position B). Finally, the fluid flowing out of the flowing passage of the valve stop 176 along substantially a vertical direction is directed by the holder 178 and tends to flow towards an area which has the smallest pressure. Hence, the fluid is then turned by substantially 90 degrees each time at substantially positions C and D. These turns significantly increase the flowing resistances of the fluid. Hence, a significant pressure drop is caused from the discharge port 152 to the high pressure side. This kind of pressure drop may result in a reduced efficiency and an increased energy consumption of the compressor.

Therefore, there is a need for a discharge valve which can effectively reduce the flowing resistance.

SUMMARY

An object of one or more embodiments of the present application is to provide a discharge valve which can reduce the flowing resistance.

Another object of one or more embodiments of the present application is to provide a discharge valve which has a low cost and a simple structure.

Still another object of one or more embodiments of the present application is to provide a compressor which has a high operating efficiency.

For achieving one or more of the above objects, a discharge valve is provided according to an aspect of the present application, which includes a valve body. A first end of the valve body is provided with a fluid inlet. A side wall of the valve body is provided with at least one fluid outlet in fluid communication with the fluid inlet, and a valve flap for opening or closing the fluid outlet. An axis direction of the fluid outlet is inclined relative to an axis direction of the fluid inlet.

Preferably, an angle between the axis direction of the fluid outlet and the axis direction of the fluid inlet is greater than 0 degree and less than or equal to 90 degrees.

Preferably, the angle between the axis direction of the fluid outlet and the axis direction of the fluid inlet is greater than or equal to 30 degrees and less than or equal to 80 degrees.

Preferably, the angle between the axis direction of the fluid outlet and the axis direction of the fluid inlet is greater than or equal to 70 degrees and less than or equal to 80 degrees.

Preferably, an angle between a plane in which the valve flap is located when the valve flap closes the fluid outlet and the axis direction of the fluid inlet is greater than or equal to 0 degree and less than 90 degrees.

Preferably, the angle between the plane in which the valve flap is located when the valve flap closes the fluid outlet and the axis direction of the fluid inlet is greater than or equal to 10 degrees and less than or equal to 60 degrees.

Preferably, the angle between the plane in which the valve flap is located when the valve flap closes the fluid outlet and the axis direction of the fluid inlet is greater than or equal to 10 degrees and less than or equal to 20 degrees.

Preferably, a point of the valve flap fixed to the valve body is located between the fluid outlet and the fluid inlet in an axial direction of the valve body.

Preferably, the discharge valve further includes a valve stop for limiting a displacement of the valve flap.

Preferably, a point of the valve stop fixed to the valve body is located between the fluid outlet and the fluid inlet in the axial direction of the valve body.

Preferably, two or three or four fluid outlets are provided, and each of the fluid outlets is provided with the valve flap.

Preferably, the fluid outlets are centrosymmetrically arranged at equal angular intervals about the axis direction of the fluid inlet.

Preferably, the fluid outlets are arranged at the same height along the axis direction of the fluid inlet.

Preferably, a second end of the valve body includes a piston.

Preferably, the discharge valve further includes a sleeve fitted with the valve body, wherein the fluid outlet is located in a cavity of the sleeve.

Preferably, a side wall of the sleeve is formed with at least one opening.

Preferably, one end of the sleeve is formed with the piston.

According to another aspect of the present application, a compressor is provided, which includes the above described discharge valve.

Preferably, the compressor is a scroll compressor, and the scroll compressor includes a non-orbiting scroll and an orbiting scroll. The first end of the valve body of the discharge valve is fixed at a discharge port of the non-orbiting scroll.

Preferably, the first end of the valve body is fixed at the discharge port by screw-thread fit or pressing fit.

Preferably, the compressor further includes a capacity modulation mechanism configured to modulate the capacity of the compressor by adjusting an axial displacement of the non-orbiting scroll, wherein the valve body of the discharge valve constitutes a portion of the capacity modulation mechanism.

Preferably, the capacity modulation mechanism further includes a capacity modulation cylinder block, and the piston on the valve body of the discharge valve is configured to be movable in the capacity modulation cylinder block.

Preferably, the compressor further includes a capacity modulation mechanism configured to modulate the capacity of the compressor by adjusting the axial displacement of the non-orbiting scroll, wherein the sleeve of the discharge valve constitutes a portion of the capacity modulation mechanism.

Preferably, the capacity modulation mechanism further includes a capacity modulation cylinder block, and the piston on the sleeve of the discharge valve is configured to be movable in the capacity modulation cylinder block.

Preferably, the capacity modulation cylinder block is in fluid communication with an external pressure source via an electromagnetic valve.

Preferably, the compressor is one of a scroll compressor, a piston compressor, a screw rod compressor, a centrifugal compressor, and a rotor compressor.

The discharge valve and the compressor according to one or more embodiments of the present application have the following advantages.

In a discharge valve according to an embodiment of the present application, the valve body includes a fluid inlet and at least one fluid outlet, and an axis direction of the fluid outlet is inclined with respect to an axis direction of the fluid inlet. Compared with a conventional discharge valve in which the axes of the fluid inlet and the fluid outlet are overlapped with or parallel to each other (as shown in FIGS. 2 to 4), the configuration in which the axis direction of the fluid outlet is inclined (here, the inclination includes the situation in which the two axes are perpendicular to each other) with respect to the axis direction of the fluid inlet according to the embodiments of the present application can reduce the flowing resistance of the fluid, thereby reducing the pressure drop caused by the discharge valve, since flow of the fluid is not required to be turned by an angle of 90 degrees for many times. In addition, since only the fluid inlet and the fluid outlet are arranged in the valve body, and a valve flap is arranged on the fluid outlet, the discharge valve according to the embodiments of the present application may have a very simple structure, and thus the manufacturing cost is reduced.

In the discharge valve according to a further embodiment of the present application, an angle formed between the axis direction of the fluid outlet and the axis direction of the fluid inlet may be greater than 0 degree and less than or equal to 90 degrees, preferably, greater than or equal to 30 degrees and less than or equal to 80 degrees, and more preferably, greater than or equal to 70 degrees and less than or equal to 80 degrees. In other words, an angle between a plane in which the valve flap is located when the valve flap closes the fluid outlet and the axis direction of the fluid inlet may be greater than or equal to 0 degree and less than 90 degrees, preferably, greater than or equal to 10 degrees and less than or equal to 60 degrees, and more preferably, greater than or equal to 10 degrees and less than or equal to 20 degrees. Compared with the conventional discharge valve shown in FIGS. 2 to 4, the discharge valve with the angle in the above ranges, particularly, in the more preferred ranges may bring a significant improvement of the operating efficiency of the compressor due to the reduction of the flowing resistance. As has been practically tested, the operating efficiency of the compressor may be increased over 3% to 6% in various operating conditions.

In a discharge valve according to a further embodiment of the present application, a point of the valve flap fixed to the valve body is located between the fluid outlet and the fluid inlet. In other words, the valve flap is arranged to be opened in a direction which allows the flowing resistance of the fluid to be minimized. Thus, the flowing resistance in the discharge valve can be further reduced.

In a discharge valve according to a further embodiment of the present application, the discharge valve may further include a valve stop for limiting a displacement of the valve flap. Hence, the probabilities of plastic deformation and fatigue failure of the valve flap can be reduced, and the reliability of the discharge valve can be increased. Furthermore, a point of the valve stop fixed to the valve body is also located between the fluid outlet and the fluid inlet, that is, the valve stop may be fixed to the valve body at the same position as the valve flap. Thus, the flowing resistance caused by the presence of the valve stop is reduced.

In the discharge valve according to a further embodiment of the present application, a first end of the valve body may be fixed at the discharge port of the compressing mechanism of the compressor by screw-thread fit or pressing fit. Since the valve body may be directly fixed at the discharge port, the holder for fixing the conventional discharge valve shown in FIGS. 2 to 4 is omitted, thereby further reducing the flowing resistance caused by the holder.

In the discharge valve according to a further embodiment of the present application, two or three or four fluid outlets may be provided, and each of the fluid outlets is provided with the valve flap. Further, these fluid outlets may be centrosymmetrically arranged at equal angular intervals about the axis direction of the fluid inlet. In addition, these fluid outlets may further be arranged at the same height in the axis direction of the fluid inlet. Adopting such configuration may increase the total cross sectional area of the fluid outlets to further reduce the pressure drop. In addition, due to the symmetric arrangement of the fluid outlets, the pressure balance at the high pressure side may be more effectively achieved, and the noise and pressure fluctuation may be more effectively reduced, thereby ensuring more stable operation of the compressor.

The compressor according to an embodiment of the present application adopts the above discharge valve and thus has the above advantages brought by the discharge valve.

In the compressor according to a further embodiment of the present application, the compressor may be a scroll compressor. The scroll compressor may include a non-orbiting scroll and an orbiting scroll, and the discharge valve is fixed at a discharge port of the non-orbiting scroll. In particular, in the case of the compressor with a variable capacity, the compressor may further include a capacity modulation mechanism configured to modulate the capacity of the compressor by adjusting an axial displacement of the non-orbiting scroll, and the valve body of the discharge valve or a sleeve fitted with the valve body may constitute a portion of the capacity modulation mechanism. More specifically, the capacity modulation mechanism may include a capacity modulation cylinder block, and the second end of the valve body of the discharge valve or the sleeve of the discharge valve may include a piston which is movable in the capacity modulation cylinder block. Since the first end of the valve body is fixedly connected to the discharge port of the non-orbiting scroll, and the piston on a second end of the valve body or the piston on the sleeve is axially movable in the capacity modulation cylinder block, the discharge valve may be driven to move axially by controlling the pressure in the capacity modulation cylinder block, thus driving the non-orbiting scroll to move axially to realize the capacity modulation function of the compressor. Since the discharge valve and the member (e.g., the piston) for controlling the capacity of the compressor are integrally configured, the number of the components is reduced and the assembling process of the compressor is simplified, thereby reducing the manufacturing cost of the compressor.

In the compressor according to a further embodiment of the present application, the compressor may be one of a scroll compressor, a piston compressor, a screw rod compressor, a centrifugal compressor, and a rotor compressor. In other words, the discharge valve according to the embodiment of the present application is applicable in various compressors, and has a good universality.

BRIEF DESCRIPTION OF THE DRAWINGS

Features and advantages of one or more embodiments of the present application can be understood more readily with reference to the description in conjunction with the drawings in which:

FIG. 1 is a longitudinal sectional view of a conventional scroll compressor;

FIG. 2 is a perspective view of the conventional discharge valve in FIG. 1;

DETAILED DESCRIPTION

Figure 3A:
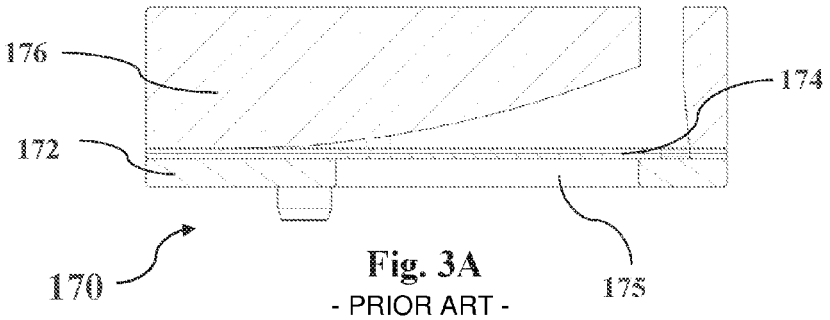
FIGS. 3A and 3B are schematic views of the discharge valve shown in FIG. 2 in a closed state and an opened state, respectively.

The following description of the preferred embodiments is only illustrative rather than limiting to the present application and application or use thereof.

The basic configuration and operation process of the conventional scroll compressor 1 has been described with reference to FIGS. 1 to 4 in the part of Background. FIG. 5 shows a scroll compressor 100A according to an embodiment of the present application. The scroll compressor 100A according to the present application adopts various discharge valves 10A, 10B, 10C and 10D shown in FIGS. 6 to 10B to replace the conventional discharge valve 170 shown in FIG. 1. In particular, the like reference signs in FIG. 1 are used in FIG. 5 to indicate the like components as shown in FIG. 1, and thus the description of configuration of these like components will not be repeated.

As shown in FIG. 5, a scroll compressor 100A according to an embodiment of the present application includes a housing 110, a top cover 112 arranged at one end of the housing 110, a bottom cover 114 arranged at the other end of the housing 110, and a partition plate 116 arranged between the top cover 112 and the housing 110 to separate an inner space of the compressor into a high pressure side and a low pressure side. The high pressure side is formed between the partition plate 116 and the top cover 112, and the low pressure side is formed among the partition plate 116, the housing 110 and the bottom cover 114. An inlet connector 118 for suctioning fluid is arranged at the low pressure side, and an outlet connector 119 for discharging the compressed fluid is arranged at the high pressure side.

Figure 6:
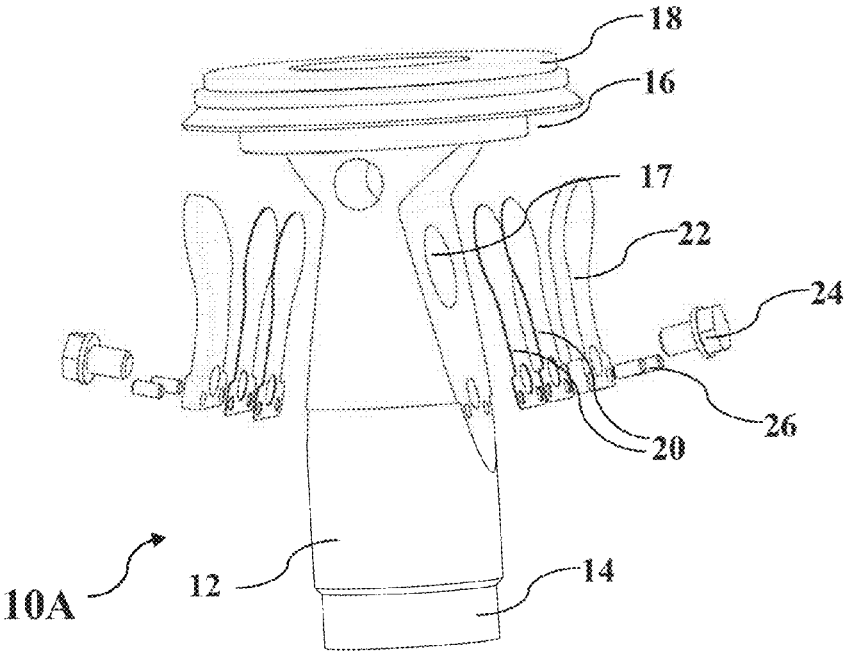
FIG. 6 shows a perspective view of a discharge valve according to a first embodiment of the present application.
Figure 7:
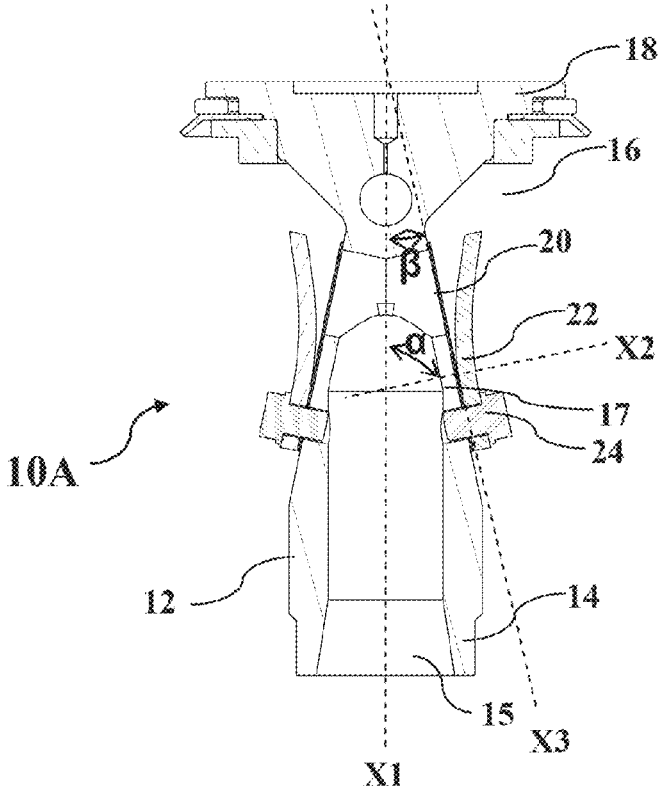
FIG. 7 shows a sectional view of the discharge valve according to the first embodiment of the present application.

A discharge valve 10A according to a first embodiment of the present application is provided at a discharge port 152 of a non-orbiting scroll 150. As shown in FIGS. 6 and 7, the discharge valve 10A may include a valve body 12. A first end 14 of the valve body 12 may be fixed at the discharge port 152 of the non-orbiting scroll 150 of the compressor 100A (e.g., by screw-thread connection or by pressing fit), and the first end of the valve body 12 is provided with a fluid inlet 15 aligned with the discharge port 152. A side wall of the valve body 12 is provided therein with at least one fluid outlet 17 (in the embodiment shown in FIGS. 6 and 7, the number of the fluid outlets 17 is two) in fluid communication with the fluid inlet 15, and a valve flap 20 for opening or closing the fluid outlet. In the embodiment shown in FIGS. 6 and 7, there may be two valve flaps 20. However, it should be appreciated by the skilled person in the art that, the number of the valve flaps 20 may also be one or more. In particular, as shown in FIG. 7, an axis direction X2 of each fluid outlet 17 is inclined relative to an axis direction X1 of the fluid inlet 15. In other words, the axis direction X1 of the fluid inlet 15 is not perpendicular to a plane X3 in which the valve flap 20 is located when the valve flap 20 closes the fluid outlet 17.

Figure 3B:
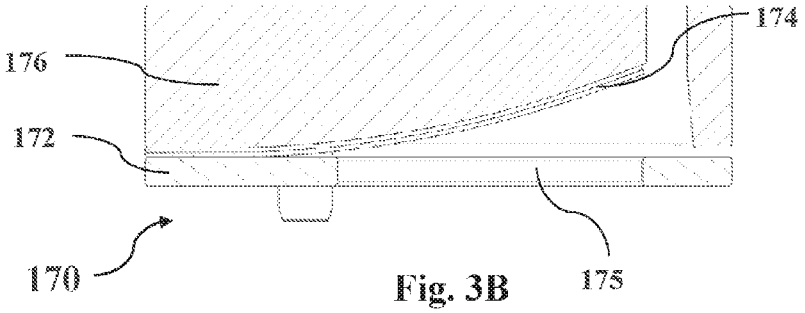
Figure 4:
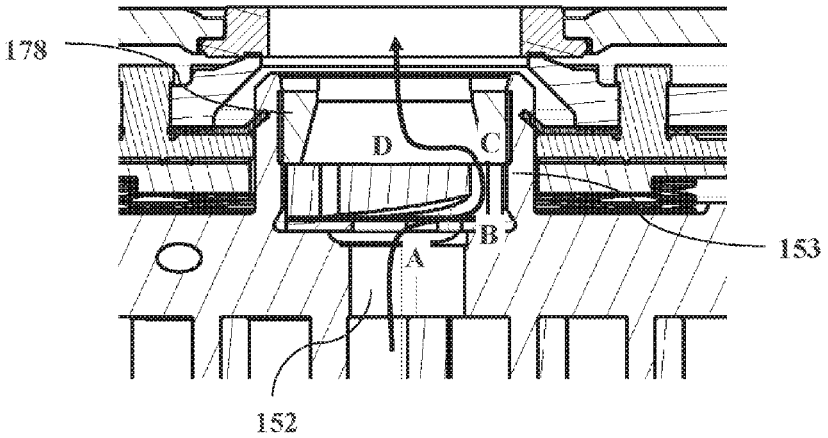
FIG. 4 is an enlarged view showing the vicinity of a discharge port of a non-orbiting scroll of the scroll compressor shown in FIG. 1.
Figure 5:
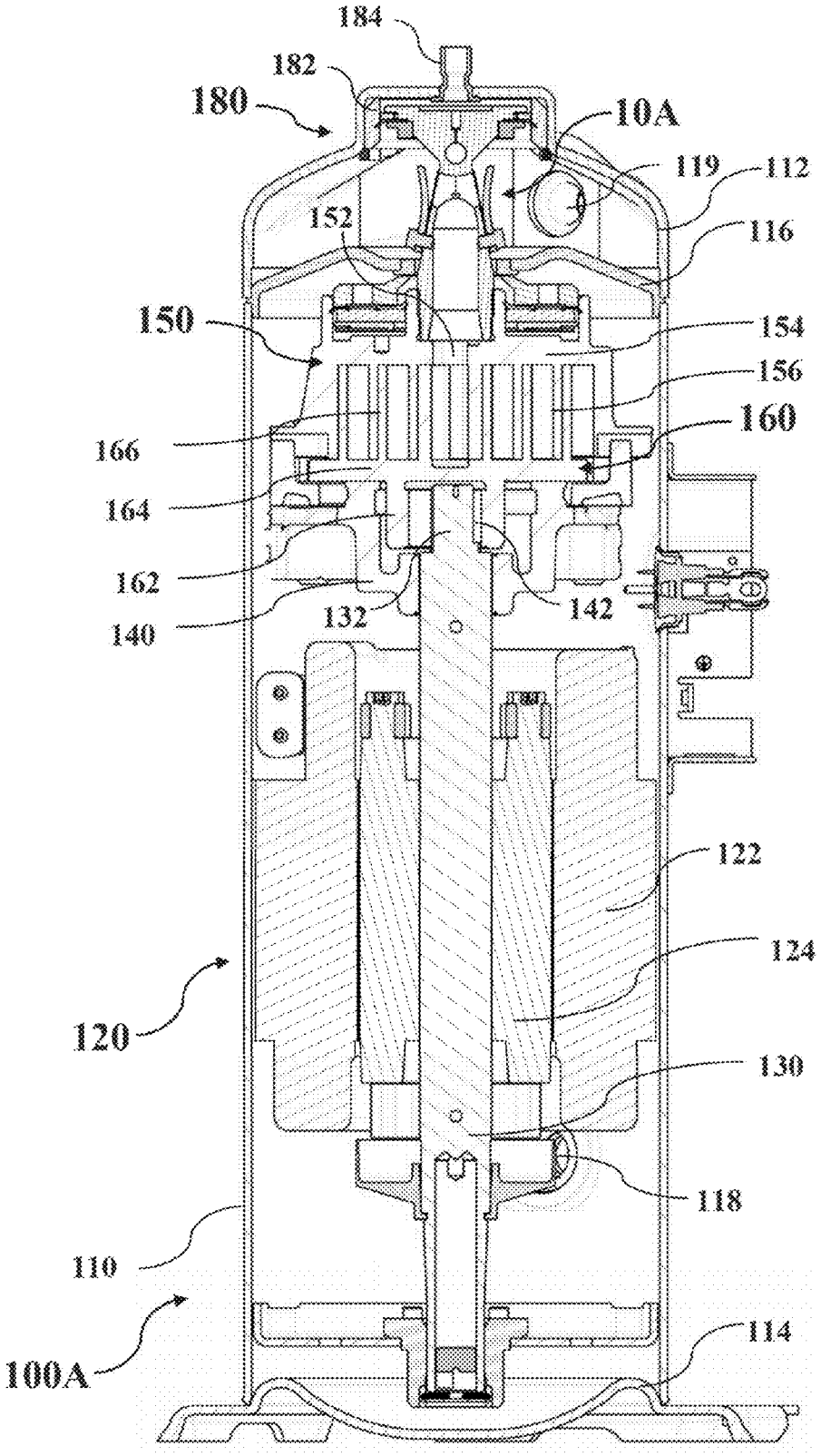
FIG. 5 shows a longitudinal sectional view of a scroll compressor according to an embodiment of the present application.

Compared with the discharge valve 170 as shown in FIGS. 2 to 4 in which the axes of the fluid inlet and the fluid outlet (they may be considered as consisting of an upper part and a lower part of the valve port 175 in the valve seat 172 respectively) are overlapped with or parallel to each other (in other words, the axis direction of the fluid inlet is perpendicular to the plane in which the valve flap 174 is located), the discharge valve 10A according to an embodiment of the present application has the axis direction X2 of the fluid outlet 17 inclined with respect to the axis direction X1 of the fluid inlet 15 (in other words, the axis direction X1 of the fluid inlet 15 is not perpendicular to the plane X3 in which the valve flap 20 is located when the valve flap 20 closes the fluid outlet 17). Therefore, in the process that the fluid enters into the valve body 12 through the fluid inlet 15 and then is discharged out of the valve body 12 through the fluid outlet 17 via the valve flap 20, the flowing direction of the fluid is not turned by a right angle (90 degrees). Thus, the flowing resistance of the discharge valve 10A may be reduced, and therefore the pressure drop caused by the discharge valve may be reduced.

In the preferred embodiment as shown in FIGS. 6 and 7, an angle α between the axis direction X2 of the fluid outlet 17 and the axis direction X1 of the fluid inlet 15 is set to be greater than or equal to 70 degrees and less than or equal to 80 degrees. Alternatively, an angle β between the plane X3 in which the valve flap 20 is located when the valve flap 20 closes the fluid outlet 17 and the axis direction X1 of the fluid inlet 15 is set to be greater than or equal to 10 degrees and less than or equal to 20 degrees.

The discharge valve 10A according to a first embodiment of the present application may further include a valve stop 22 for limiting a displacement of the valve flap 20. The valve flap 20 and the valve stop 22 may be fixed to the valve body 12 via fasteners such as a bolt 24. Furthermore, for facilitating the assembly and preventing the valve flap or the valve stop from rotating about the bolt 24, a pin 26 may be further adopted to achieve further positioning.

In particular, a point of the valve flap 20 fixed to the valve body 12 (e.g., the position of the bolt 24) may be arranged to locate between the fluid outlet 17 and the fluid inlet 15 in an axial direction of the valve body. In other words, the opening direction of the valve flap 20 is arranged in a direction which allows the flowing resistance of the fluid to be minimized. Such configuration can further reduce the flowing resistance in the discharge valve 10A. Further, a point of the valve stop 22 fixed to the valve body 12 (e.g., the position of the bolt 24) may also be arranged to locate between the fluid outlet 17 and the fluid inlet 15 in an axial direction of the valve body.

The inventor made a comparison test between the discharge valve as shown in FIGS. 6 and 7 according to the present application, and the discharge valve as shown in FIG. 2. The result is shown in table 1.

TABLE 1

| comparison test | | | | | | |
|---|---|---|---|---|---|---|
| | | | | | EER | |
| test sequence No. | discharge valve type | operating condition (° F.) (intake temperature/ discharge temperature) | cooling capacity per unit time | power consumption (watt) | cooling capacity/power consumption | difference |
| 1 | the present | 45/130 | 130191.3 | 11388 | 11.43 | 4.08% |
| 2 | application | 45/100 | 158108.96 | 8268 | 19.12 | 7.01% |
| 3 | conventional | 45/130 | 129305.53 | 11774 | 10.98 | |
| 4 | discharge valve shown in FIG. 2 | 45/100 | 157024.84 | 8787 | 17.87 | taken this as reference |
| 5 | the present | 45/130 | 129790.58 | 11381 | 11.40 | 3.84% |
| 6 | application | 45/100 | 157837.52 | 8279 | 19.06 | 6.69% |
| 7 | no discharge | 45/130 | 129963.49 | 11375 | 11.43 | 4.08% |
| 8 | valve | 45/100 | 158072.41 | 8195 | 19.29 | 7.94% |

The inventor made four groups of tests to the discharge valve according to the present application under different operating conditions (reference may be made to the test sequence Nos. 1, 2, 5 and 6), and made two groups of tests to the conventional discharge valve as shown in FIG. 2 under different operating conditions (reference may be made to the test sequence Nos. 3 and 4). EER (=cooling capacity of the compressor/power consumption of the compressor) is adopted to represent the operating efficiency of the compressor. The EER of a compressor provided with the discharge valve according to the present application and the EER of a compressor provided with none of any types of discharge valves are calculated by taking the EER of a compressor provided with the conventional discharge valve as shown in FIG. 2 as a reference. The result shows that, in a circumstance that an intake temperature and a discharge temperature of the compressor are respectively at 45° F. and 130° F. the EER of the compressor adopting the discharge valve according to the present application is increased by 3.84% to 4.08%, and in a circumstance that the intake temperature and the discharge temperature of the compressor are respectively at 45° F. and 100° F., the EER of the compressor adopting the discharge valve according to the present application is increased by 6.69% to 7.01%.

For verifying the reliability of the above test, the inventor further made two groups of tests to the compressor in which no discharge valve is provided (reference may be made to the test sequence Nos. 7 and 8). The testing result shows that, compared with a compressor with a conventional discharge valve, the EER of a compressor with no discharge valve is respectively increased by 4.08% and 7.94%.

According to the above results, it is obvious that the operating efficiency of the compressor provided with the discharge valve according to the present application is significantly higher than that of the compressor provided with the conventional discharge valve, and is slightly lower than the operating efficiency of the compressor in which no discharge valve is provided. Considering that, in many circumstances, it is necessary to provide a discharge valve to prevent the fluid with high pressure from flowing backward, the effect brought by the discharge valve according to the present application is very significant compared with a conventional discharge valve, and goes beyond the anticipation of the skilled person in the art.

Furthermore, as shown in FIG. 5, the scroll compressor 100A according to an embodiment of the present application may be a compressor which has a variable capacity. Hence, the scroll compressor 100A further includes a capacity modulation mechanism 180. The capacity modulation mechanism 180 modulates the capacity of the compressor by adjusting an axial displacement of the non-orbiting scroll 150 (i.e., the axial distance between the non-orbiting scroll 150 and an orbiting scroll 160).

Reference is also made to FIGS. 6 and 7. The valve body 12 of the discharge valve 10A may constitute a portion of the capacity modulation mechanism 180. The capacity modulation mechanism 180 further includes a capacity modulation cylinder block 182, and the second end 16 of the valve body 12 of the discharge valve 10A may include a piston 18 which is movable in the capacity modulation cylinder block 182. The capacity modulation cylinder block 182 is in fluid communication with an external pressure source via a connecting pipe 184. An electromagnetic valve may be provided in a pipeline of the connecting pipe 184 to control the pressure in the capacity modulation cylinder block 182.

In practical operation, when the capacity of the scroll compressor 100A is required to be reduced, the electromagnetic valve in the pipeline of the connecting pipe 184 is controlled to reduce the pressure in the capacity modulation cylinder block 182, and thus the piston 18 at the second end 16 of the discharge valve 10A will move upwardly. Since the first end 14 of the discharge valve 10A is fixedly connected to the discharge port 152 of the non-orbiting scroll 150, the non-orbiting scroll 150 is lifted upwardly, so as to form clearances between a spiral blade 156 of the non-orbiting scroll 150 and a end plate 164 of the orbiting scroll 160 as well as between the spiral blade 166 of the orbiting scroll 160 and the end plate 154 of the non-orbiting scroll 150. Then, a part of compressed fluid may be leaked to the low pressure side through the clearances, thus reducing the capacity of the compressor. In contrary, when it is required to increase the capacity of the scroll compressor 100A, the electromagnetic valve in the pipeline of the connecting pipe 184 is controlled to increase the pressure in the capacity modulation cylinder block 182. Thus, the piston 18 at the second end 16 of the discharge valve 10A will move downwardly. Therefore, the non-orbiting scroll 150 will be pressed downwardly to close the clearances between the non-orbiting scroll 150 and the orbiting scroll 160, thus increasing the capacity of the compressor.

Figure 8A:
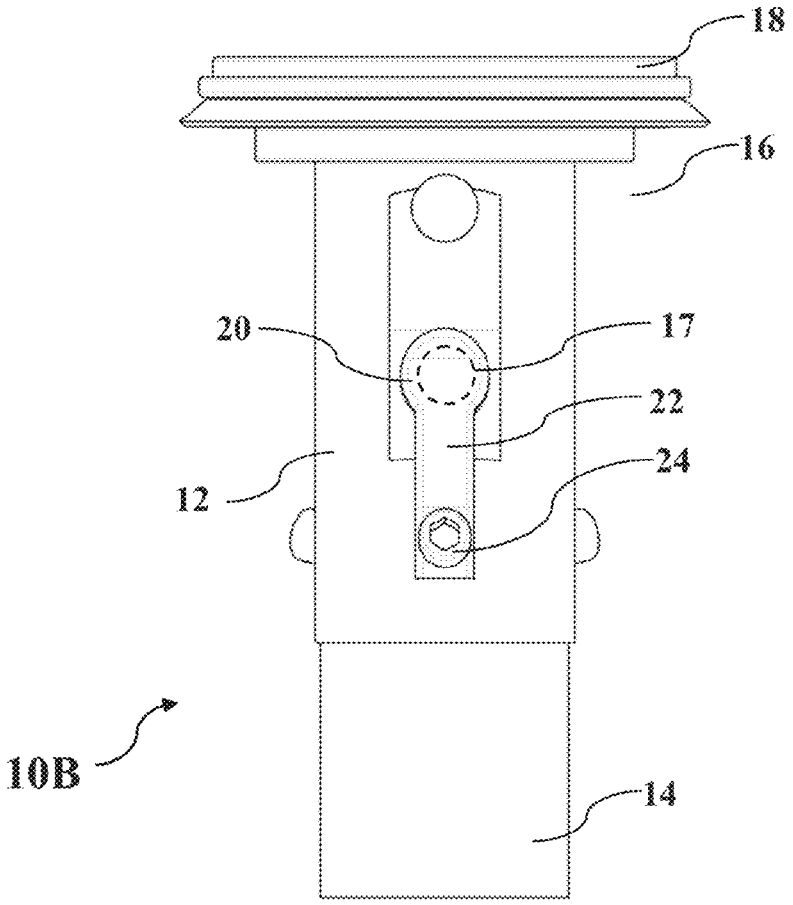
FIGS. 8A and 8B are a front view and a bottom view of a discharge valve according to a second embodiment of the present application, respectively.
Figure 8B:
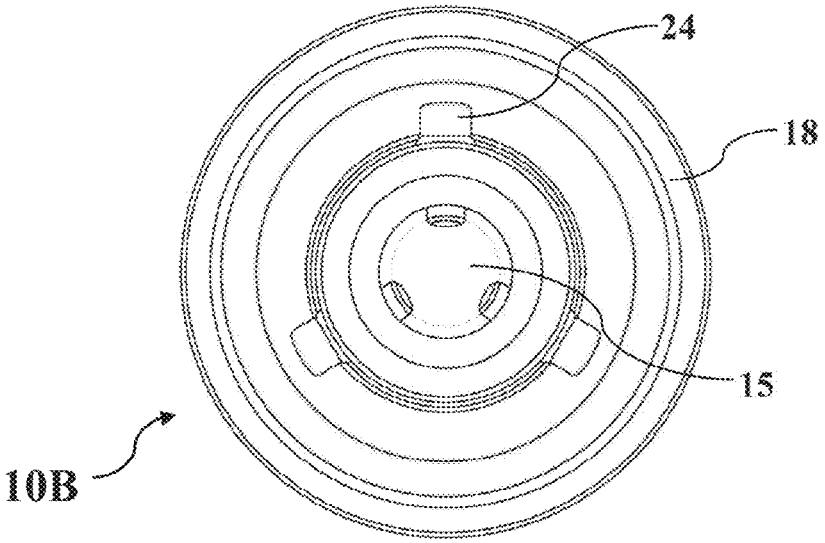

FIGS. 8A and 8B are a front view and a bottom view of a discharge valve 10B according to a second embodiment of the present application, respectively. Unlike the first embodiment of the present application, three fluid outlets 17 and three sets of valve flaps 20 and valve stops 22 are provided in the discharge valve 10B according to the second embodiment of the present application. Furthermore, these fluid outlets 17 may be centrosymmetrically arranged at equal angular intervals about the axis direction of the fluid inlet 15. In addition, these fluid outlets 17 may be arranged at the same height along the axis direction of the fluid inlet 15.

Figure 9A:
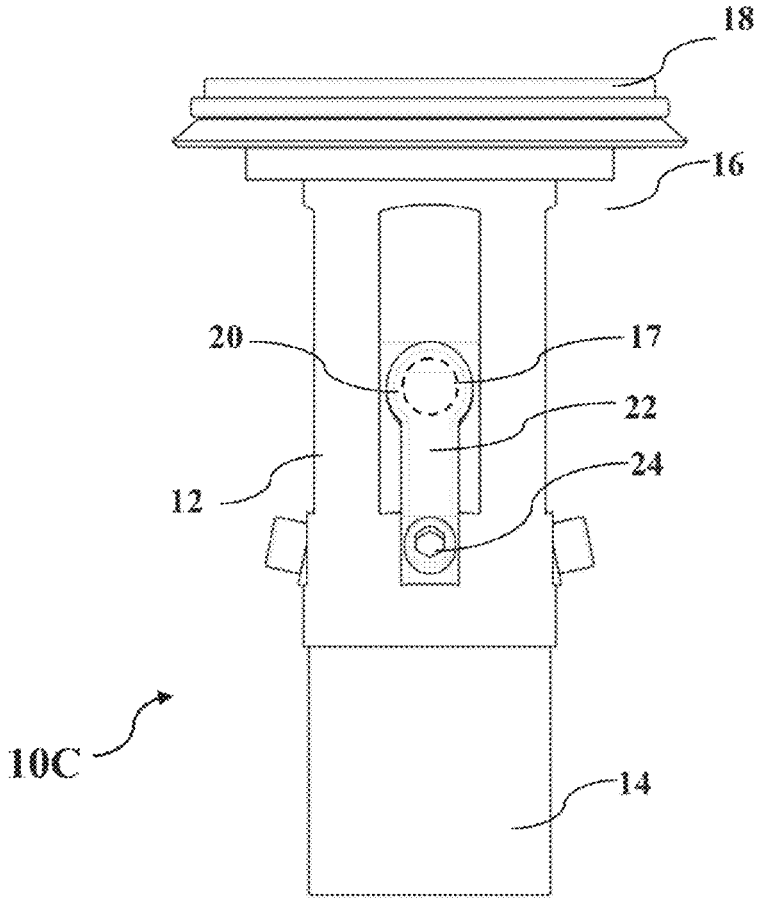
FIGS. 9A and 9B are a front view and a bottom view of a discharge valve according to a third embodiment of the present application, respectively.
Figure 9B:
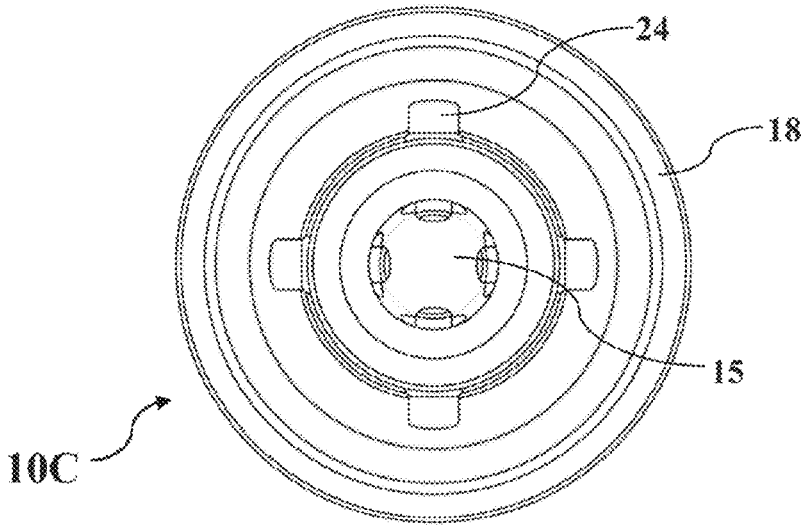

FIGS. 9A and 9B are a front view and a bottom view of a discharge valve 10C according to a third embodiment of the present application, respectively. Unlike the first embodiment of the present application, four fluid outlets 17 and four sets of valve flaps 20 and valve stops 22 are provided in the discharge valve 10C according to the third embodiment of the present application. Furthermore, these fluid outlets 17 may be centrosymmetrically arranged at equal angular intervals about the axis direction of the fluid inlet 15. In addition, these fluid outlets 17 may be arranged at the same height along the axis direction of the fluid inlet 15.

Figure 10A:
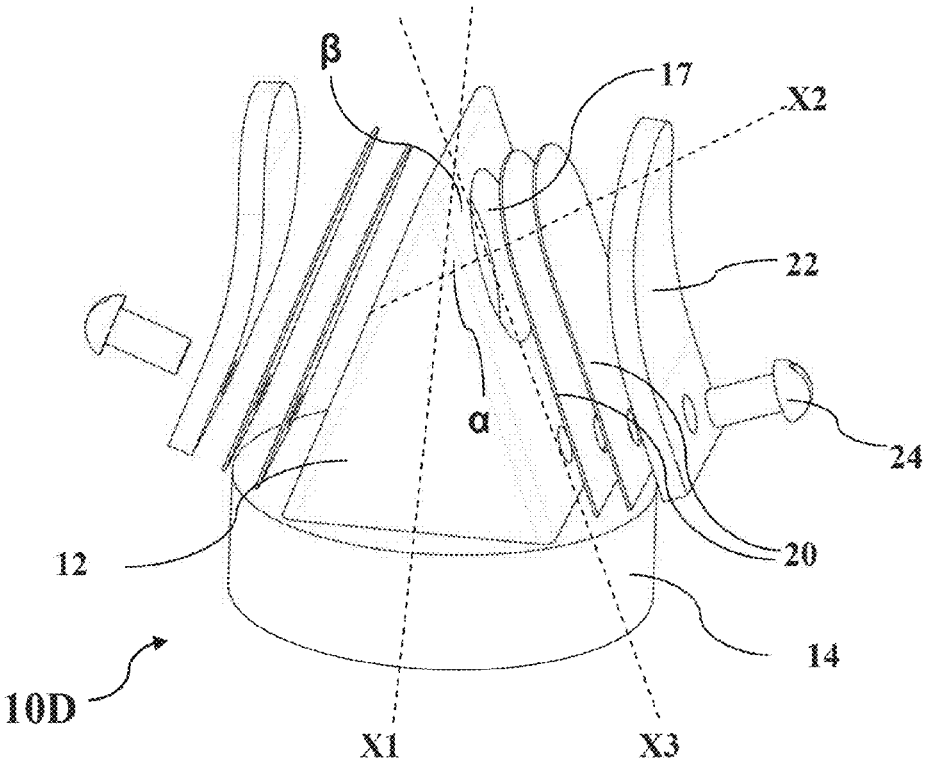
FIGS. 10A and 10B are an exploded perspective view and an assembling perspective view of a discharge valve according to a fourth embodiment of the present application, respectively.
Figure 10B:
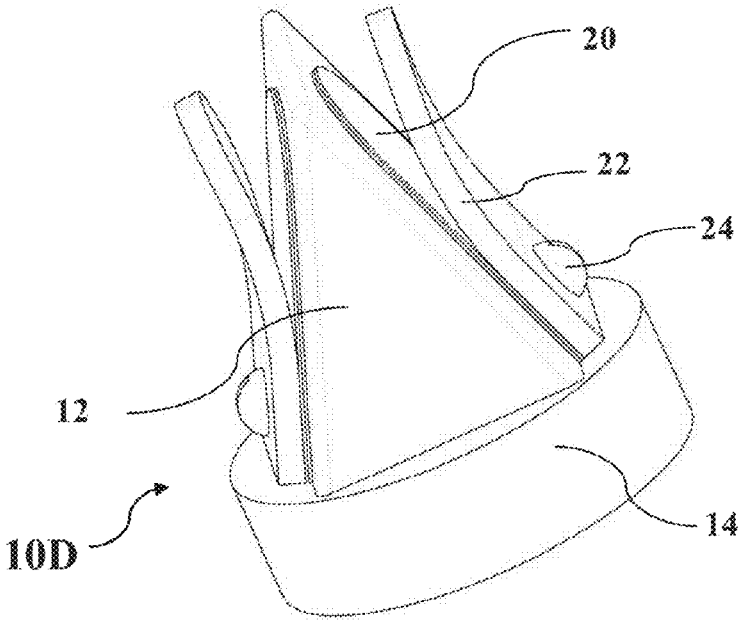

FIGS. 10A and 10B are an exploded perspective view and an assembly perspective view of a discharge valve 10D according to a fourth embodiment of the present application, respectively. Unlike the above first, second and third embodiments of the present application, the discharge valve 10D according to the fourth embodiment of the present application is provided with no piston for capacity modulation, hence, has a simpler structure, and is applicable in a compressor which has a fixed capacity or a scroll compressor which achieves capacity adjustment by other methods.

Figure 11:
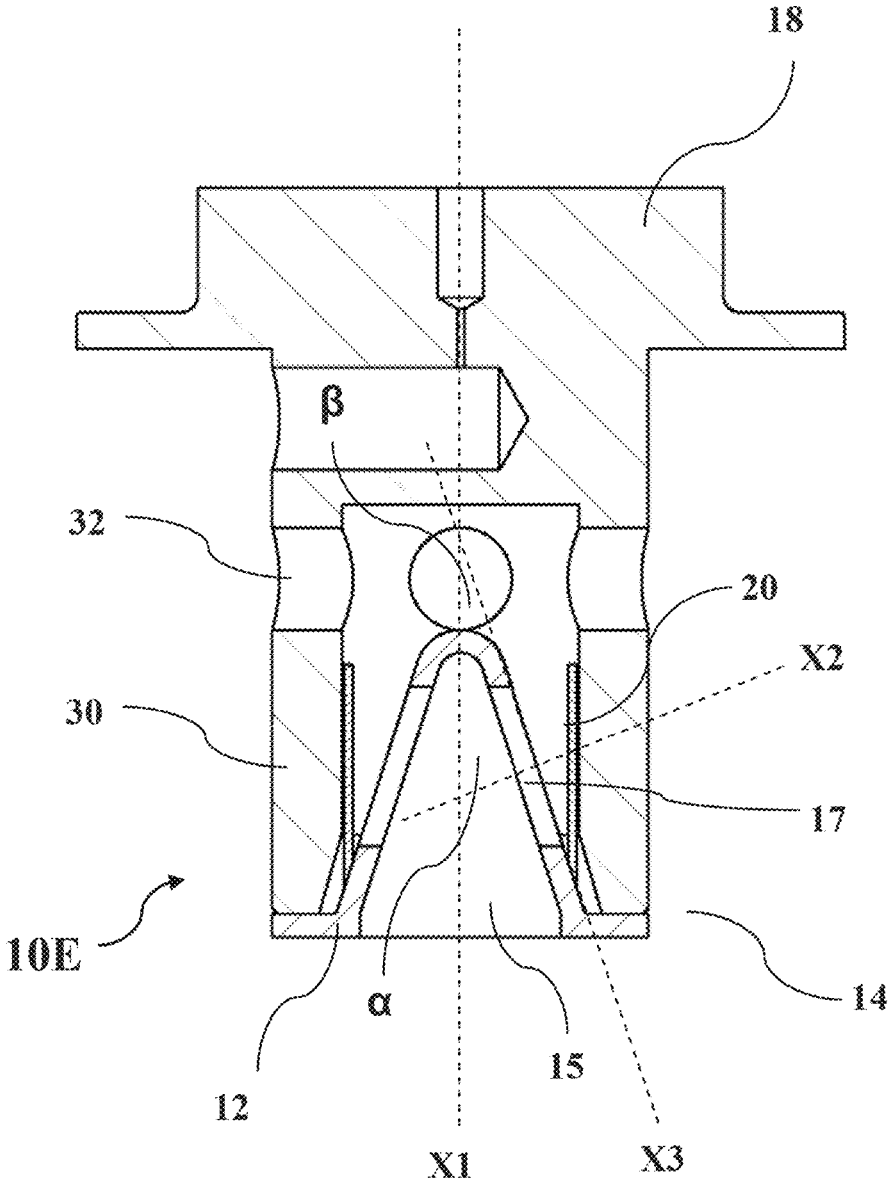
FIG. 11 is a longitudinal sectional view of a discharge valve according to a fifth embodiment of the present application.

FIG. 11 shows a discharge valve 10E according to a fifth embodiment of the present application. The configurations and relationships of the valve body 12, the fluid inlet 15, the fluid outlet 17, the valve flap 20 and the like of the discharge valve 10E as shown in FIG. 11 are similar to those in the embodiment as shown in FIGS. 10A and 10B, which are not repeated herein. It is to be noted particularly that the valve flap 20 shown in FIG. 11 is in an opened state. However, unlike the fourth embodiment, the discharge valve 10E further includes a sleeve 30 fitted with the valve body 12, and the fluid outlet 17 is located inside the cavity of the sleeve 30. The sleeve 30 may be fixedly connected to the valve body 12, for example, by pressing fit, screw-thread connection or welding, etc. A side wall of the sleeve 30 may be formed therein with at least one opening 32. One end of the sleeve 30 may be formed as the piston 18. The discharge valve 10E as shown in FIG. 11 is also applicable in the scroll compressor having the capacity modulating function as shown in FIG. 5. More specifically, the sleeve 30 or the valve body 12 may be fixed at the discharge port 152 of the non-orbiting scroll 150, and the piston 18 on the sleeve 30 may be fitted in the capacity modulation cylinder block 182. Similarly, the scroll compressor adopting the discharge valve 10E according to this embodiment may perform capacity modulation by the above described method.

In the above preferred embodiment, an example in which the angle α is set to be greater than or equal to 70 degrees and less than or equal to 80 degrees (or the angle β is set to be greater than or equal to 10 degrees and less than or equal to 20 degrees) is given. However, it should be appreciated by the skilled person in the art that, the present application is not limited to this, the above angles α and β may be other values to achieve an effect slightly worse than that achieved by selecting the above preferred range but still better than the effect achieved by a conventional discharge valve. For example, the angle α between the axis direction X2 of the fluid outlet 17 and the axis direction X1 of the fluid inlet 15 may be greater than or equal to 30 degrees and less than or equal to 80 degrees. In other words, the angle β between the plane X3 in which the valve flap 20 is located when the valve flap 20 closes the fluid outlet 17 and the axis direction X of the fluid inlet 15 may be greater than or equal to 10 degrees and less than or equal to 60 degrees.

Further, the angle α between the axis direction X2 of the fluid outlet 17 and the axis direction X1 of the fluid inlet 15 may be greater than 0 degree and less than or equal to 90 degrees. In other words, the angle β between the plane X3 in which the valve flap 20 is located when the valve flap 20 closes the fluid outlet 17 and the axis direction X1 of the fluid inlet 15 may be greater than or equal to 0 degree and less than 90 degrees.

Though the fluid inlet and the fluid outlet in the embodiments described above with reference to the drawings are shown in a circular shape, it should be appreciated by the skilled person in the art that, the fluid inlet and the fluid outlet each may have any other shape other than the circular shape.

Similar to the first embodiment, in the second, third, fourth and fifth embodiments as shown in FIGS. 8A to 11, the valve flap may be a single valve flap, but it may also be two or multiple overlapped valve flaps. Furthermore, similar to the second and third embodiments as shown in FIGS. 8A to 9B, the fourth and firth embodiments as shown in FIGS. 10A, 10B and 11 may also be modified as including multiple fluid outlets.

Furthermore, the effect of the discharge valve according to the embodiments of the present application is described with reference to a scroll compressor, however, it should be appreciated by the skilled person in the art that, the discharge valve according to the present application may further be applied in other types of compressor, including but not limited to a piston compressor, a screw rod compressor, a centrifugal compressor, and a rotor compressor, so as to achieve the effect of reducing the pressure drop caused by the discharge valve, and increasing the operating efficiency of the compressor. Furthermore, it should be appreciated by the skilled person in the art that the discharge valve according to the present application may also be applied in other machines which requires to control the discharge of the fluid, such as a pump, etc.

While various embodiments of the present application have been described in detail herein, it should be understood that the present application is not limited to the specific embodiments described in detail and illustrated herein, and those skilled in the art can make other variations and modifications without departing from the principle and scope of the application. These variations and modifications should be deemed to fall into the protective scope of the application. Furthermore, all the elements described herein can be replaced by other technically equivalent elements.

What is claimed is:

1. A discharge valve, comprising:

a valve body having a first end provided with a fluid inlet, a second end opposite the first end, and a side wall located between the first end and the second end, wherein the first end of the valve body is adapted to be attached to a compression mechanism at a discharge port of the compression mechanism such that the fluid inlet received fluid from the discharge port during operation of the compression mechanism, wherein the side wall of the valve body is provided therein with at least one fluid outlet in fluid communication with the fluid inlet, and a valve flap for opening or closing the fluid outlet, wherein an axis direction of the fluid outlet is inclined relative to an axis direction of the fluid inlet.

2. The discharge valve according to claim 1, wherein an angle between the axis direction of the fluid outlet and the axis direction of the fluid inlet is greater than 0 degree and less than or equal to 90 degrees.

3. The discharge valve according to claim 2, wherein the angle between the axis direction of the fluid outlet and the axis direction of the fluid inlet is greater than or equal to 30 degrees and less than or equal to 80 degrees.

4. The discharge valve according to claim 3, wherein the angle between the axis direction of the fluid outlet and the axis direction of the fluid inlet is greater than or equal to 70 degrees and less than or equal to 80 degrees.

5. The discharge valve according to claim 1, wherein an angle between a plane in which the valve flap is located when the valve flap closes the fluid outlet and the axis direction of the fluid inlet is greater than or equal to 0 degree and less than 90 degrees.

6. The discharge valve according to claim 5, wherein the angle between the plane in which the valve flap is located when the valve flap closes the fluid outlet and the axis direction of the fluid inlet is greater than or equal to 10 degrees and less than or equal to 60 degrees.

7. The discharge valve according to claim 6, wherein the angle between the plane in which the valve flap is located when the valve flap closes the fluid outlet and the axis direction of the fluid inlet is greater than or equal to 10 degrees and less than or equal to 20 degrees.

8. The discharge valve according to claim 1, wherein a point of the valve flap fixed to the valve body is located between the fluid outlet and the fluid inlet in an axial direction of the valve body.

9. The discharge valve according to claim 8, wherein the discharge valve further comprises a valve stop for limiting a displacement of the valve flap.

10. The discharge valve according to claim 9, wherein a point of the valve stop fixed to the valve body is located between the fluid outlet and the fluid inlet in the axial direction of the valve body.

11. The discharge valve according to claim 1, wherein two, three or four fluid outlets are provided, and each of the fluid outlets is provided thereon with the valve flap.

12. The discharge valve according to claim 11, wherein the fluid outlets are centrosymmetrically arranged at equal angular intervals about the axis direction of the fluid inlet.

13. The discharge valve according to claim 11, wherein the fluid outlets are arranged at the same height along the axis direction of the fluid inlet.

14. The discharge valve according to claim 1, wherein a second end of the valve body comprises a piston.

15. The discharge valve according to claim 1, further comprising a sleeve fitted with the valve body, wherein the fluid outlet is located in a cavity of the sleeve.

16. The discharge valve according to claim 15, wherein a side wall of the sleeve is formed therein with at least one opening.

17. The discharge valve according to claim 15, wherein one end of the sleeve is formed with a piston.

18. A compressor, comprising a discharge valve comprising:

a valve body having a first end provided with a fluid inlet, wherein a side wall of the valve body is provided therein with at least one fluid outlet in fluid communication with the fluid inlet, and a valve flap for opening or closing the fluid outlet, wherein an axis direction of the fluid outlet is inclined relative to an axis direction of the fluid inlet, and wherein the compressor is a scroll compressor, and the scroll compressor comprises a non-orbiting scroll and an orbiting scroll, and the first end of the valve body of the discharge valve is fixed at a discharge port of the non-orbiting scroll.

19. The compressor according to claim 18, wherein the first end of the valve body is fixed at the discharge port by screw-thread fit or pressing fit.

20. The compressor according to claim 18, further comprising a capacity modulation mechanism configured to modulate the capacity of the compressor by adjusting an axial displacement of the non-orbiting scroll, wherein the valve body of the discharge valve constitutes a portion of the capacity modulation mechanism.

21. The compressor according to claim 20, wherein the capacity modulation mechanism further comprises a capacity modulation cylinder block, and a piston on the valve body of the discharge valve is configured to be movable in the capacity modulation cylinder block.

22. The compressor according to claim 21, wherein the capacity modulation cylinder block is in fluid communication with an external pressure source via an electromagnetic valve.

23. The compressor according to claim 18, further comprising a capacity modulation mechanism configured to modulate the capacity of the compressor by adjusting an axial displacement of the non-orbiting scroll, wherein a sleeve of the discharge valve constitutes a portion of the capacity modulation mechanism.

24. The compressor according to claim 23, wherein the capacity modulation mechanism further comprises a capacity modulation cylinder block, and a piston on the sleeve of the discharge valve is configured to be movable in the capacity modulation cylinder block.

25. The compressor according to claim 24, wherein the capacity modulation cylinder block is in fluid communication with an external pressure source via an electromagnetic valve.

* * * * *